US005778831A

United States Patent [19]

Jameel

[11] Patent Number: 5,778,831

[45] Date of Patent: Jul. 14, 1998

[54] SOOTBLOWER LANCE WITH EXPANDED TIP

[75] Inventor: Mohomed I. Jameel, Lawrenceville, Ga.

[73] Assignee: Bergemann USA, Inc., Atlanta, Ga.

[21] Appl. No.: 628,284

[22] Filed: Apr. 5, 1996

Related U.S. Application Data

[63] Continuation-in-part of Ser. No. 210,321, Mar. 18, 1994, Pat. No. 5,505,163.

[51] Int. Cl.[6] ..... F22B 37/52; F22B 37/48

[52] U.S. Cl. ..... 122/392; 122/390; 122/405

[58] Field of Search ..... 122/379, 390, 122/392, 405

[56] References Cited

U.S. PATENT DOCUMENTS

| | | | |
|---|---|---|---|
| 330,443 | 11/1885 | Vanduzen . | |
| 4,276,856 | 7/1981 | Dent et al. | 122/392 |
| 4,452,183 | 6/1984 | Yazidjian | 122/392 |
| 4,565,324 | 1/1986 | Rebula et al. | 239/290 |
| 4,769,085 | 9/1988 | Booij | 122/392 |
| 5,063,632 | 11/1991 | Clark et al. | 15/316.1 |
| 5,230,306 | 7/1993 | Barringer et al. | 122/383 |
| 5,271,356 | 12/1993 | Kling et al. | 122/392 |
| 5,375,771 | 12/1994 | Jameel et al. | 239/567 |
| 5,505,163 | 4/1996 | Jameel | 122/379 |

FOREIGN PATENT DOCUMENTS

| | | | |
|---|---|---|---|
| PCT/US90/00688 | 2/1990 | WIPO | B05B 1/00 |

OTHER PUBLICATIONS

Modern Compressible Flow with Historical Perspective, John P. Anderson, Jr., 1982.

The Dynamics and Thermodynamics of Compressible Fluid Flow, Ascher H. Shapiro, 1953.

Sootblower Optimization–Part I, M. I. Jameel et al., Pulp & Paper, Sep. 20–23, 1993.

Hydrodynamic Behavior of Pressurized Steam Flowing Through a Sootblower Nozzle, M.I. Jameel et al., Pulp & Paper.

Initial Expansion Region of an Underexpanded Nozzle, M. I. Jameel, Univ. of Toronto.

The Analytical Design of an Axially Symmetrical Laval Nozzle for a parallel and Uniform Jet, Kuno, Foelsch, Mar. 1949.

*Primary Examiner*—Henry A. Bennett
*Assistant Examiner*—Gregory A. Wilson
*Attorney, Agent, or Firm*—Isaf, Vaughan & Kerr

[57] ABSTRACT

A nozzle for a sootblower is used to project a cleaning agent against the internal surfaces of a boiler for removing fireside deposit. The nozzle of the present invention incorporates a passageway having a convergent segment between its entrance end most narrow point, the throat. Extending from the throat to the nozzle's exit is an expansion chamber in which the cleaning fluid passing therein expands and drops in pressure to substantially ambient pressure. The flow streams of the jet of the cleaning agent discharged from the nozzle is essentially parallel to the center axis of the nozzle. Additionally, the nozzles can be mounted diametrically opposed or spaced along the longitudinal axis of the lance tube. Moreover, the nozzles mounted in a lance tube can be mounted flush with the outside surface of the lance tube, contoured to its shape. In one embodiment, a sootblower lance is provided with an expanded tip portion to reduce turbulence and pressure variations caused by inwardly protruding nozzles in the interior of the lance tube.

24 Claims, 7 Drawing Sheets

SOOTBLOWER LANCE WITH EXPANDED TIP

REFERENCE TO RELATED APPLICATION

This application is a continuation-in-part application of Ser. No. 08/210,321, filed Mar. 18, 1994, now U.S. Pat. No. 5,505,163.

FIELD OF THE INVENTION

This invention generally relates to an improved sootblower and is more particularly concerned with a sootblower nozzle and lance tip configuration providing improved cleaning effect over conventional nozzle and tip designs.

BACKGROUND OF THE INVENTION

The accumulation of fireside deposits on the internal heating surfaces of boilers drastically reduces their thermal conductivity and efficiency and, if not removed, requires periodic shutdowns of the boiler for manual cleaning. The principal means for removing fireside deposit accumulation in boilers is a cleaning device known as a sootblower. A conventional sootblower typically consist of an elongated lance or tube having a plurality of nozzles that direct jets of a compressible cleaning agent under pressure, such as steam, gas or vapor, sidewise from the lance against the internal surfaces of the boiler. The cleaning effectiveness of a sootblower depends to a great degree on the nozzle design which controls the mass flow, exit speed and the jet decay characteristics of the exiting jets. The cleaning effectiveness is also a function of the internal flow of the cleaning agent within the lance itself. A more unrestricted flow leads to an increased effectiveness.

The sootblower nozzle design most commonly used today is based on the de Laval design comprising convergent and conical divergent flow sections which form a venturi. The pressure of the cleaning agent increases as it passes through the convergent segment of the nozzle, attaining the local speed of sound at the throat of the nozzle. The pressure of the cleaning agent then decreases further through the conical expansion section, expanding and accelerating from the nozzle throat to the nozzle exit and thereby typically exceeding the speed of sound as the cleaning agent exits. The pressure drop over the expansion section is controlled by the designed geometry of that section, primarily the divergence angle and length. Conventional belief is that the optimum divergence angle is about 15° or less so as to prevent the attendant generation of turbulence.

The cleaning potential of the jet emitted from a nozzle is commonly measured in terms of the jet's Peak Impact Pressure (PIP). The maximum PIP is delivered by nozzles where the pressure of the cleaning agent jet exiting the nozzle jet equals the ambient pressure surrounding the lance tube, thereby resulting in a "fully expanded" jet. Nozzles which allow the pressure of the exit jet to be greater than the ambient pressure result in an "under expanded" jet. In the case of under expanded jets, the pressure of the exiting jet is higher than the ambient pressure so the exiting jet must finish expanding outside the nozzle causing a series of expansion and contraction waves called "shock waves." These "shock waves" convert a substantial part of the kinetic energy of the jet stream into internal energy, thereby markedly reducing the PIP.

A "full expansion" nozzle is achieved by designing the nozzle with a specific ratio between the area of the nozzle's exit to the area of the nozzles's throat. The ratio is determined by the particular nozzle inlet pressure. In practice, this means the length of the expansion segment of the nozzle, $L_n$, needs to be extended to allow for the full expansion and the corresponding drop in pressure of the cleaning agent down to the ambient pressure at the nozzle's exit. However, the size of the sootblower lance tubes as well as the openings in the boiler wall through which the lance tube is inserted limit the elongation of conventional nozzles to achieve full expansion. This is shown in Table I where the prior art full expansion nozzle requires a nozzle length of approximately 3.5 to 5.0 inches. However, the inside diameter of the lance tube to which these nozzles are attached is only about 3.0 inches, restricting conventional nozzle lengths to approximately 1.63 inches. Furthermore, the sleeve diameter of the opening in the boiler wall through which the lance tube is inserted dramatically restricts the projection of the nozzle outside the lance tube. Table I below gives a comparison of the nozzle lengths of conventional nozzles which are under expanded and the same nozzle made full expansion.

TABLE 1

| Nominal Size (in.) | Throat Area ($in^2$) | Flow Rate* (lbs/sec.) | Conventional Under Expanded Nozzle Length (in.) | Full Expansion Nozzle Length (in.) |
|---|---|---|---|---|
| 7/8 | 0.601 | 2.24 | 1.63 | 3.45 |
| 1 | 0.785 | 2.93 | 1.63 | 3.86 |
| 1 1/8 | 0.994 | 3.71 | 1.63 | 4.95 |

*For 300 psi inlet pressure and 600° F. superheated steam.

Consequently, the shorter under expanded nozzles are used in conventional sootblowers. These circumstances are most apparent with the so called long retractable sootblowers, such as the one disclosed in European Patent No. 159,128. The sootblower of the '128 patent uses a lance tube typically having a plurality of under expanded nozzles at its working end which are generally positioned opposite to each other, with aligned center axes or slightly staggered center axes in order to offset the jet reaction forces, as seen in FIG. 2 of the '128 patent.

A nozzle designed to emulate the characteristics of a full expansion nozzle while having dimensions allowing it to be incorporated into a sootblower lance tube is disclosed in U.S. Pat. No. 5,271,356 to Kling et al. The nozzle device taught in the '356 patent utilizes a plug mounted to the back wall of the lance tube or supported by a radially extending support vane, as seen in FIGS. 4 and 5 of the '356 patent. Inherent with such a design is the workmanship involved in the fabricating and mounting the plug and nozzle outer shell. Moreover, the plug must remain concentric in respect to the nozzle outer shell or the nozzle performance is diminished.

In many prior art sootblowers, the nozzles in the lance extend a substantial distance into the interior of the lance tube. This situation is to some extent unavoidable since the physical size of the nozzles are determined at least in part by physical constraints. Unfortunately, these nozzles tend to restrict the flow of cleaning agent along the interior passageway of the lance. As a result, turbulence that degrades the PIP of the sootblower can occur. In addition, the nozzles positioned downstream of other nozzles can receive cleaning agent under reduced pressure due to the restricted flow caused by inwardly protruding upstream nozzles. This can further degrade the PIP of these nozzles and thus can degrade the effectiveness of the sootblower as a whole.

BRIEF DESCRIPTION OF THE INVENTION

Briefly described, the present invention includes a sootblower nozzle for mounting in a sootblower lance that produces a substantially fully expanded jet of a compressible cleaning agent with the mass flow comparable to conventional nozzles. The sootblower nozzle of the present invention includes a confined path comprising, in coaxial relationship, an upstream entrance portion, a throat, an expansion chamber or portion and a downstream discharge end. The entrance portion has an entrance passageway which is defined by a convergent inner surface which merges with a cylindrical throat and through which the cleaning agent is discharged, thereby obtaining the speed of sound. The expansion chamber and the discharge end of the nozzle are of a designed geometry such that the cleaning agent passing through the expansion chamber of the nozzle expands rapidly in the vicinity of the throat so as to obtain the full expansion at or prior to the time that the gas passes out of the discharge end of the nozzle.

To achieve the controlled early expansion of the cleaning agent, a first embodiment of the present invention provides an abruptly larger cylindrical expansion chamber adjacent to and downstream of the nozzle throat which is defined by a reaction wall and an inner expansion surface of uniform diameter throughout its length. The sudden change in cross-sectional area in the passageway from the nozzle throat to the inner expansion surface of the expansion chamber causes the rapid expansion of the cleaning agent passing through the nozzle and the formation of a toroidal recirculating bubble of cleaning agent adjacent the throat where the reaction wall and inner expansion surface merge. The bulk of the cleaning agent flows over this toroidal recirculating bubble. In doing so, the cleaning agent of the primary flow stream expands through the expansion chamber of the nozzle.

In a second embodiment of the present invention, the controlled early expansion of the cleaning agent is produced by a companulate inner wall or surface defining the expansion chamber. The inner expansion surface is comprised of a conical portion defined by a divergence angle and, in cross-section, a curvilinear portion mathematically defined. The cleaning agent passing through the nozzle rapidly expands through the conical portion and is then redirected in the curvilinear portion. The expansion chamber merges with the discharge end portion.

The nozzles of the present invention are disposed on opposite sides of a lance tube circumferentially about 180° apart so as to discharge in opposite directions and along a common transverse center axis or slightly staggered along the longitudinal axis of the lance tube so as to allow for longer nozzles. Additionally, the nozzle of the present invention can be arcuate at its discharge end so as to be flush with the curvature of the outer surface of the lance tube.

Still another embodiment of the invention addresses the problem of restricted flow through the lance due to the protrusion of nozzle bodies into the interior passageway of the lance. In this embodiment, the lance is provided with an expanded tip portion having a diameter greater than that of the lance body. The nozzles of the sootblower are mounted within the expanded tip portion and can be positioned in aligned or offset relationship relative to each other. Since the interior diameter of the expanded tip portion is greater than that of the lance body, the inwardly protruding nozzles present less of an obstruction to the flow of cleaning fluid within the top portion. As a consequence, the nozzles are presented with a more uniform and less turbulent flow and nozzles that are more downstream are not subjected to a reduced pressure. This substantially increases the efficiency of the sootblower.

Accordingly, it is an object of the present invention to provide a sootblower having a nozzle which substantially overcomes the disadvantages of under expansion and is suitable for use within the available space which accommodates a conventional sootblower.

Another object of the present invention is to provide a sootblower with a nozzle which is capable of efficiently generating a columnar jet stream of cleaning agent at a high velocity.

Another object of the present invention is to provide a sootblower having a nozzle that permits controlled expansion of the cleaning agent inside the nozzle and essentially eliminates shock waves in the jet.

Another object of the present invention is to provide a sootblower having a nozzle that provides for rapid expansion of the cleaning agent within the expansion chamber of the nozzle and allows the nozzle to be as short as practicable to fit in a sootblower.

Another object of the present invention is to provide a sootblower having a nozzle which produces a jet of cleaning agent flowing in a substantially uniform column parallel to the nozzle's central axis.

Another object of the present invention is to provide a sootblower having a nozzle which will produce a more concentrated jet than nozzles having conical divergent discharge passageways.

Another object of the present invention is to provide a sootblower having a nozzle with improved cleaning characteristics.

Another object of the present invention is to provide a sootblower having nozzles which will facilitate the discharging of a cleaning agent which will clean more efficiently a greater area and will travel further into the boiler.

Another object of the present invention is to provide a more efficient sootblower nozzle which when effectively used will improve the boiler thermal efficiency.

Another object of the present invention is to provide a sootblower nozzle which, when used, will lengthen the time between boiler shutdowns for cleaning.

Another object of the present invention is to provide a sootblower nozzle that can be easily mounted as a replacement for nozzles of previously existing sootblowers.

Another object of the present invention is to provide a sootblower nozzle which eliminates the need for welding or mounting additional parts on a sootblower and is easily fabricated.

Another object of the present invention is to provide a sootblower nozzle which is inexpensive to manufacture, durable in structure and efficient in operation.

Another object of the present invention is to provide a sootblower nozzle which will fit blower tubes of various diameters.

Another object of the present invention is to provide a sootblower nozzle with improved cleaning capability or will conserve the amount of the cleaning agent used.

Another object of the present invention is to provide a sootblower nozzle which provides increased cleaning energy over a wide range of nozzle pressures.

Another object of the present invention is to provide a sootblower lance wherein flow restriction and losses due to the protrusion of the nozzles into the lance passageway is reduced or eliminated to create higher pressure, more consistent, and more efficient jets of cleaning agents issuing from the sootblower.

Other objects, features and advantages of the present invention will become apparent from the following description when considered in conjunction with the accompanying drawings wherein like characters of reference designate corresponding parts throughout the several views.

DETAILED DESCRIPTION OF THE PREFERRED EMBODIMENTS

Figure 1:
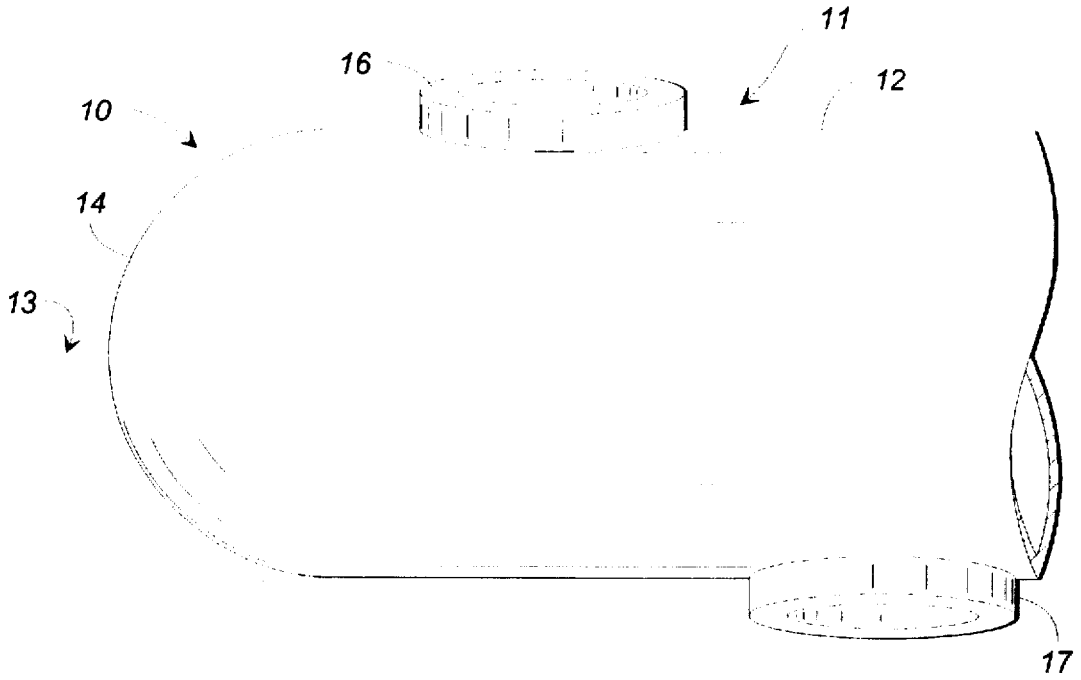
FIG. 1 is a fragmentary perspective view of a portion of a sootblower constructed in accordance with the present invention.

Referring now in more detail to the embodiments chosen for the purpose of illustrating the present invention, numeral 11 in FIG. 1 denotes the lance or tube of a sootblower 10 of the present invention, the lance tube having a straight, hollowed tubular main body 12 which is inserted into a boiler, not shown, where it is rotated and/or oscillated about its longitudinal axis 13 for directing a compressible cleaning agent radially or sidewise of the main body 12 into the interior of a boiler. The main body 12 is closed at its distal end by a rounded, usually hemispherical outwardly protruding end 14.

The main body 12 is usually about 8 inches long with an outside diameter of approximately 3.5 inches, a wall thickness of approximately 0.25 inches and an inside diameter of about 3.0 inches. Body 12 is integrally joined to an otherwise conventional feeder tube, not shown, having an opposite end fixed to a motor driven carriage, not shown. The main body 12 is made of heat resistant material, such as stainless steel.

Mounted radially in the cylindrical main body 12 are axially spaced, substantially identical, nozzles 16 and 17 constructed in accordance with the present invention. The nozzles 16 and 17 are spaced from each other along the longitudinal axis 13 of body 12 and are circumferentially spaced about 180° from each other, so as to discharge simultaneously in opposite, offset radial directions.

Nozzles 16 and 17 are identical, each being a cylindrical shell machined from heat resistance rod material, such as stainless steel rods, and respectfully radially received in space circumferentially disposed holes in body 12. The nozzles 16 and 17 are respectively fixed in place by welding, or alternatively, the lance tube and nozzles can be cast to form an integral piece.

Figure 2:
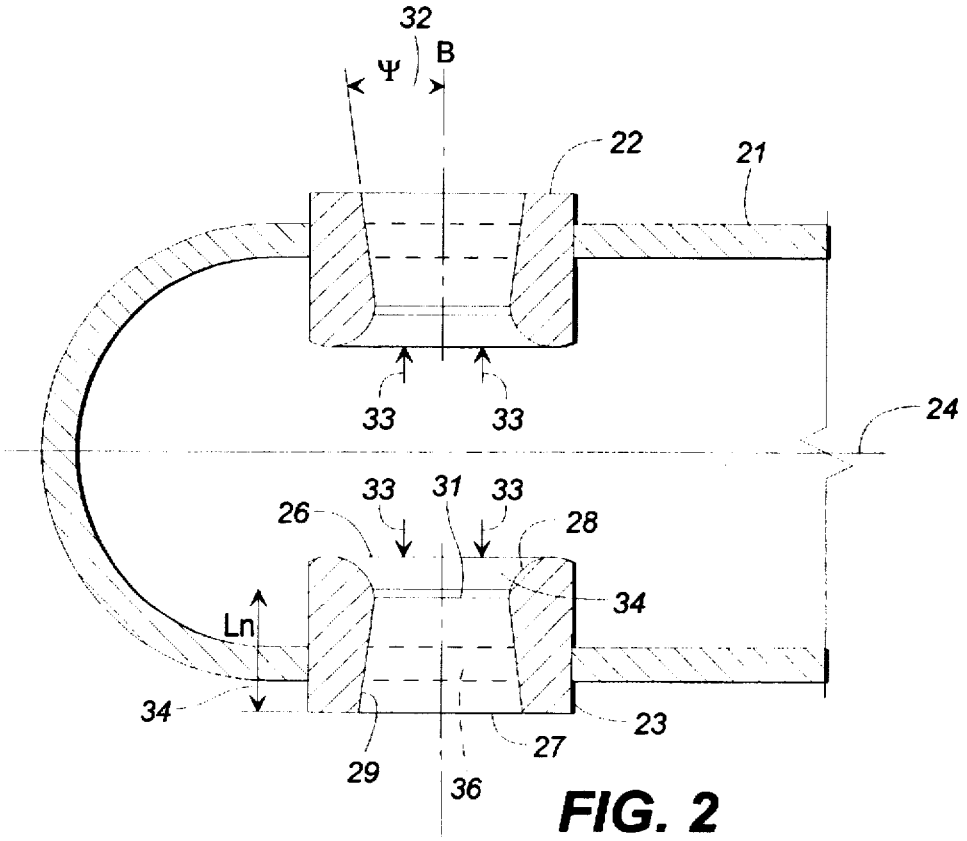
FIG. 2 PRIOR ART
FIG. 2 is a cross-sectional view of a conventional sootblower lance showing a conventional prior art nozzle.

To contrast the present invention I have shown, in FIG. 2, conventional prior art lance tube 21 typically incorporating de Laval nozzles 22, 23 aligned coaxially perpendicular to the longitudinal axis 24 of lance tube 21. The nozzles 22, 23 comprise an entrance end 26 and discharge end 27 connected by a passageway, defined by converging wall 28 and diverging wall 29. Converging wall 28 and diverging wall 29 merge at the most narrow point of the passageway for defining a throat 31. The diverging wall 29 of nozzles 22, 23 defined the divergence angle $\psi$ denoted by numeral 32.

The compressible cleaning agent under pressure, such as steam, gas or vapor, passes through nozzles 22, 23 in the direction of arrows 33, entering entrance end 26 and thence through the converging section 34 defined by wall 28. At the throat 31, the cleaning agent reaches the local speed of sound. This speed is achieved by a reduction in the cleaning agent pressure. Beyond the throat area 31, the cleaning agent is further accelerated to speeds exceeding the speed of sound. The cleaning agent then passes into the expansion chamber 36 defined by wall 29 where the cleaning agent progressively expands, resulting in a corresponding drop in pressure throughout the length 34 of expansion chamber 36. Thence, the cleaning agent exits the nozzle from the discharge end 27 of nozzles 22, 23.

The amount of expansion of the gas passing through a conventional nozzle 22, or 23 is controlled by the nozzle geometry. The expansion of a fluid in expansion chamber 36 is given by:

$$\frac{P_o}{P_e} = \left(1 + \frac{\gamma - 1}{2} M_e^2\right)^{\frac{\gamma}{\gamma-1}} \tag{1}$$

where $P_o$=lance pressure, $P_e$=exit pressure, $M_e$=Mach number at the exit, and $\gamma = C_p/C_v$ for the cleaning agent.

If it is desired to reach atmospheric pressure $P_\infty$ at the nozzle exit so as to have full expansion, then the exit Mach number (the ratio of gas velocity to local speed of sound) $M_e$ is given by equation (1). By the conservation of mass, the ratio of exit area $A_e$ to throat area $A_T$ can be expressed in terms of the exit Mach number $M_e$ given by:

$$\frac{A_e}{A_T} = \left(\frac{d_e}{d_T}\right)^2 = \frac{1}{M_e}\left[\left(\frac{2}{\gamma+1}\right)\left(1 + \frac{\gamma-1}{2} M_e^2\right)\right]^{\frac{\gamma+1}{2(\gamma-1)}} \tag{2}$$

Knowing $M_e$ from equation (1) and given the throat diameter $d_T$ by the required mass flow, the exit diameter $d_e$ can be derived from equation (2). Furthermore, for a conical nozzle the following relation holds true:

$$\frac{d_e - d_T}{2L_n} = \tan\left(\frac{\psi}{2}\right) \tag{3}$$

where $\psi$=divergence angle and $L_n$=length of expansion chamber.

Thus, the expansion chamber length $L_n$ for a full expansion nozzle can be calculated as done in Table 1, column 5.

Limited by the inside diameter of conventional lance tube 21 and the opening in the boiler wall, the length, $L_n$, 34 of the expansion chamber 36 of nozzles 23, is limited, such that the cleaning agent passing through nozzles 23 typically expands sufficiently for the pressure of the exiting cleaning agent to be typically about 4 times that of the ambient pressure. Consequently, the discharging cleaning agent is "under expanded," resulting in an uncontrolled expansion of this cleaning agent outside the nozzle and a reduction in the available cleaning energy in the exiting jet. Therefore, it is desirable to have a nozzle capable of allowing the cleaning agent passing through it to expand sufficiently, prior to its discharge, so that the pressure of the exiting cleaning agent jet is substantially equal to the ambient pressure.

Unconditionally, increasing the divergence angle $\psi$ of nozzles 22, 23 is not a viable solution for achieving greater expansion within the available space, because there is a resulting boundary layer separation, as mentioned previously.

FIG. 2 also illustrates another problem with prior art sootblower lances. Since the interior diameter of the lance is fixed and the length of the nozzles extending beyond the lance are determined by physical constraints, the nozzle bodies themselves protrude a substantial distance into the interior of the lance. Obviously, this protrusion reduces the cross-sectional area of the lance passageway at the position of each nozzle. In some cases, the nozzles can protrude into the lance passageway a distance greater than the radius of the passageway, causing an extreme obstruction.

The protruding nozzles in the lance passageway confine the passageway and create restrictions to the flow of cleaning fluid along the passageway. The more the nozzles protrude into the passageway, the greater the restriction. As a result, cleaning fluid moving under high pressure along the passageway is speeded up and its pressure reduced by the protruding nozzles. Further, the nozzles create substantial turbulence in the flow of cleaning fluid and this turbulence draws energy from the moving stream reducing its pressure further. In sootblowers where a number of nozzles are positioned along the length of the lance, nozzles on the downstream end of the lance tip can receive cleaning fluid under a pressure substantially reduced from that at which the leading nozzles receive cleaning fluid. As a result of the flow restriction, turbulence, and reduced pressure, the efficiency of the sootblower as a whole can be substantially reduced and some of the nozzles can become completely ineffective.

Figure 3A:
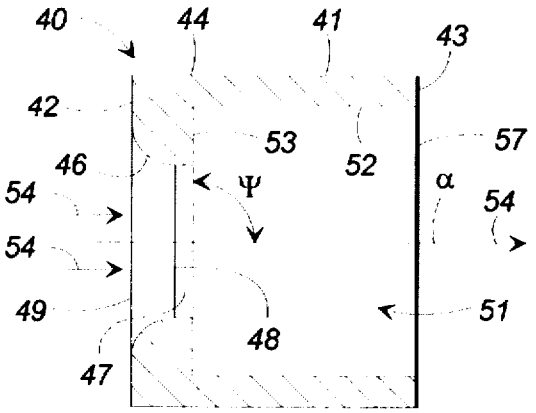
FIG. 3A is an enlarged cross-sectional view of a nozzle of the sootblower shown in FIG. 1.
Figure 3B:
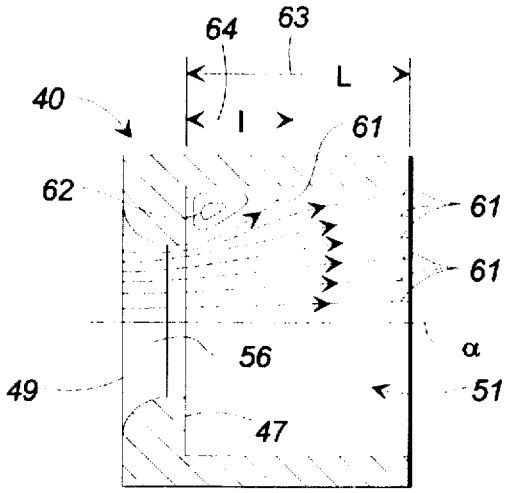
FIG. 3B is an enlarged cross-sectional view similar to FIG. 3A and showing the flow lines therein, depicting the fluid flow in the nozzle.

In accordance with the present invention, a first embodiment referred to as a rapid expansion nozzle is depicted in FIGS. 3A and 3B. Rapid expansion nozzle 40 has a cylindrical body, denoted generally by numeral 41, body 41 having a central longitudinal axis $\alpha$, a radially disposed front upstream surface 42 and a radially disposed rear down stream surface 43. Body 41 is symmetrical about axis $\alpha$, having an outer surface 44 of uniform diameter throughout its length and a hollow interior passageway. The hollow interior includes a fluid intake zone defined by a circular converging surface wall 46 from the upstream surface 42 inwardly to a circular throat or mouth 47. The throat 47 forms a restricted area through which the cleaning agent passes. In cross-section the converging surface or wall 46 is convex, and tapers in a downstream direction to merge parallel to the nozzle axis $\alpha$ at section 48 of throat 47. Thus, the converging surface defies an entrance 49 through which the cleaning agent passes.

The nozzle body 41 is counter bored from the down stream surface inwardly for providing an intermediate rapid expansion chamber or portion 51, defined by a circular inner expansion surface or wall 52 which is of uniform diameter essentially throughout its length and is concentric with outer wall 44, about axis $\alpha$.

Also produced by the counterboring is a radially disposed, flat reaction wall 53 surrounding the discharge end of throat 47. In cross-section the reaction wall 53 is perpendicular to the axis $\alpha$ of inner wall 52. Hence, as seen in FIGS. 3A and 3B, reaction wall 53 forms a divergence angle $\psi$ of 90°.

In operation, a cleaning agent enters nozzle 41 in the direction indicated by arrows 54 through opening 49 into converging chamber 56 defined by wall 46 and thence into throat 47. As with the prior art nozzles, the cleaning agent reaches a speed of sound at the throat 47. Having passed through throat 47, the cleaning agent is discharged into the central portion of the upstream end of the expansion chamber or passage 51 where it expands and decreases in pressure. Subsequently exiting the nozzle 40 at discharge end 57.

Referring to FIG. 3B, the typical stream lines for the flow field of the cleaning agent passing through nozzle 40 are illustrated by lines 61. As a flow field is initially established, a recirculating toroidal bubble 62 is formed in the junction of walls 53 and 52. As a result, the recirculating toroidal bubble 62 acts a solid body such that the cleaning agent within the flow field slides by the recirculating toroidal bubble 62 as it passes from throat 47 through expansion chamber 51. Consequently, the cleaning agent rapidly expands in the portion of expansion chamber 51 adjacent to throat 47 earlier than the expansion achieved in conventional nozzles. Therefore, the cleaning agent jet discharged from nozzle 40 is substantially fully expanded so as to maximize the cleaning energy (PIP) in the jet. In order to achieve this effect, the length 63 of expansion chamber 51 must be greater than the length 64 of the recirculating toroidal bubble 62. In conventional operation, length 63 of the divergent segment is approximately 1.30 to 1.50 inches, 1.46 inches ideally. See Table II below. In addition of the fact that this nozzle provides rapid expansion, it also provides a gas stream exiting nozzle 40 that is traveling parallel to the nozzle's axis $\alpha$.

TABLE II

SELECTED GEOMETRICAL PROPERTIES FOR RAP-FE & C-FE NOZZLE; USING AIR.
ATMOSPHERIC PRESSURE $P_\infty$ = 14.7 PSIG.
AIR TEMPERATURE 68° F. AND $d_T$ = 1"

| RAPID EXPANSION NOZZLE | CONTOUR NOZZLE | | PRIOR ART FEN | | | Q |
|---|---|---|---|---|---|---|
| $L_D$(in) | $L_{D1}$ (in) | $L_{D2}$ (in) | $L_D$ (in) | $P_o$ (psig) | $d_e$ (in) | (SCFM) |
| 1.46 | 3.47 | 1.78 | 2.62 | 200 | 1.55 | 2916 |
| 1.46 | 3.86 | 1.94 | 3.09 | 250 | 1.65 | 3594 |
| 1.46 | 4.22 | 2.08 | 3.52 | 300 | 1.74 | 4273 |

Figure 4A:
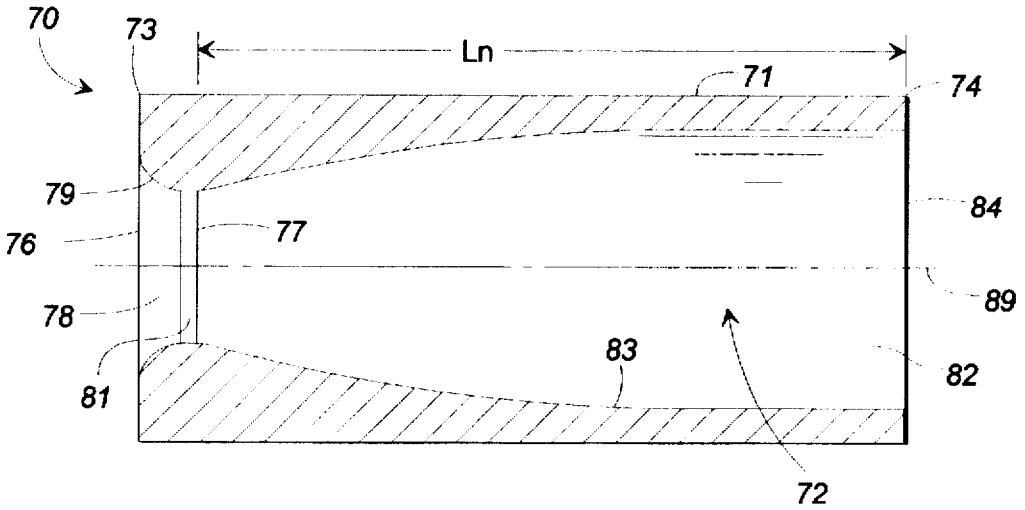
FIG. 4A is an enlarged cross-sectional view of a second embodiment of the sootblower nozzle of the present invention.
Figure 4B:
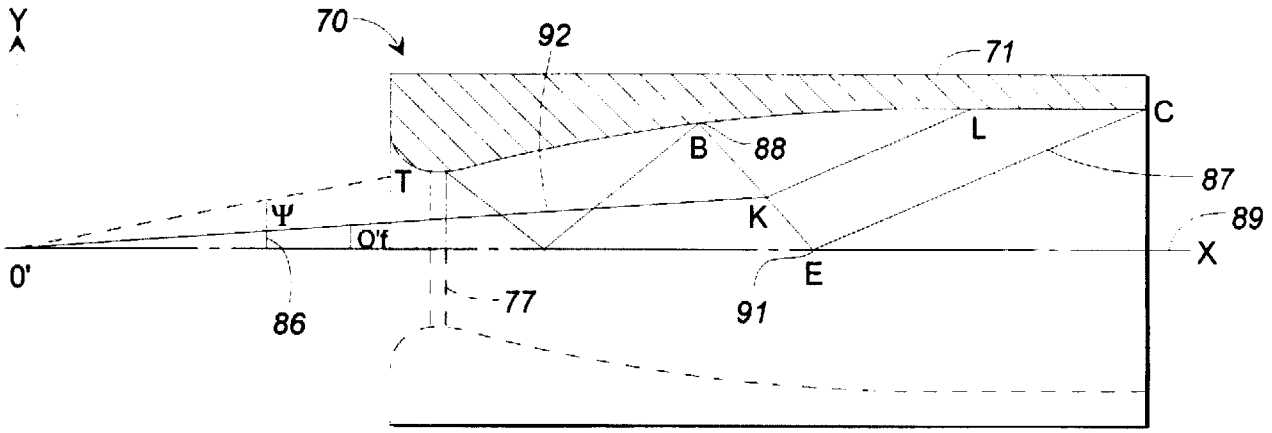
FIG. 4B is a view similar to FIG. 4 and illustrating the flow of wave KL through the nozzle.
Figure 4C:
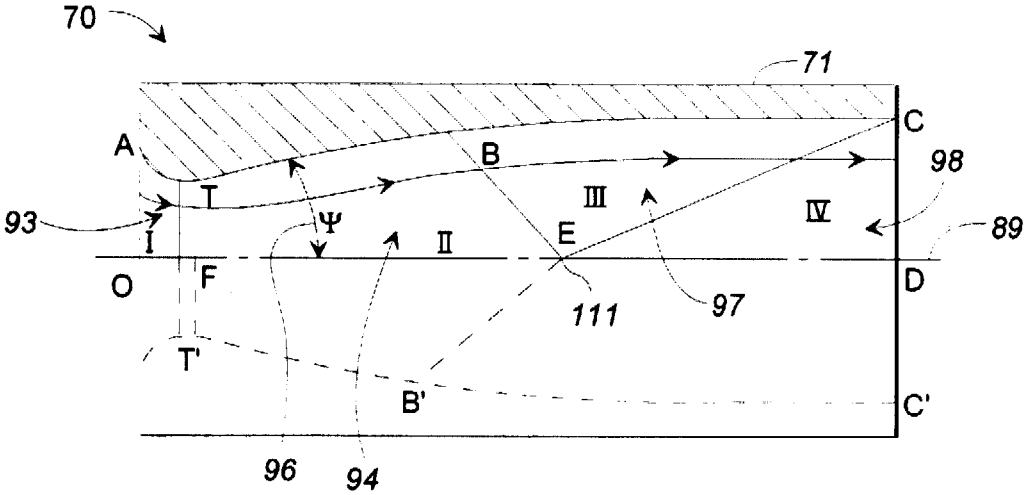
FIG. 4C is a view similar to FIG. 4 and showing the flow regions of the nozzle.

$P_o$ - Blowing pressure
$L_D$ - Nozzles length, divergent section
$L_{D1}$ - Length divergent section, C-FE nozzle
$L_{D2}$ - Length divergent section, C-FE nozzle truncated
$d_e$ - Nozzle exit diameter
$d_T$ - Nozzle throat diameter
Q - Volume flow rate
FEN - Full Expansion Nozzle A second embodiment of the present invention, contour nozzle 70, is illustrated in FIGS. 4A, 4B and 4C. Contoured rapid expansion nozzle 70 comprises a body 71 having a passageway 72 extending between an entrance end 73 and discharge end 74. An opening 76 in entrance end 73 is in communication with a throat 77 via convergent zone 78 defined by inner surface 79. The throat area 81 forms a restricted area and is selected so that the mass flow of nozzle 70 is equivalent to that of conventional nozzles. Spanning between throat 77 and discharge end 74 is expansion chamber 82 defined by inner expansion surface 83. Disposed at discharge end 74 is opening 84.

In operation, a cleaning agent enters nozzle 70 through opening 76 into convergent zone 78 defined by wall 79 terminating at throat 77. The cleaning agent then passes through throat 77 into expansion chamber 82 defined by inner expansion surface 83 which extends from throat 77 to discharge end 74. The cleaning agent exits nozzle 70 at its discharge end 74. The early expansion of cleaning agent in expansion chamber 82 of nozzle 70 is best explained by briefly stating the applicable theories of flow field then defining and analyzing four flow regions for half of the nozzle's passageway where a mirror image of this flow is found below the nozzle axis 59.

The theory upon which the present invention operates is that, upon passing the throat 77 the gas exceeds the speed of sound and is supersonic. The flow through nozzle 49 is modeled as if it is emerging from a fictitious point source 0' as shown in FIG. 4B. Due to the change in angle $\psi$, denoted by numeral 86 and defining the wall TB, an expansion wave is set up as shown by the heavy line 87 in FIG. 4B. The nozzle is chosen such that only a single reflection of this wave is permitted as indicated by point B, denoted by numeral 88. Also, the nozzle is chosen such that at the point of intersection of this reflected wave 87 and the axis 89 of the nozzle, shown here by point E which is denoted by numeral 91, is the point where full expansion occurs. The curvilinear wall BC, in redirecting the flow to emerge parallel to the axis 89, prevents any appreciable reflection of these waves on the nozzle wall. At discharge end 74 inner expansion surface 83 is essentially cylindrical.

For purposes of explaining the relevant physics involved in this flow, consider one such wave KL, denoted by numeral 92, emerging across BE. By solving for the flow along KL as shown below, it is possible to trace the transient curve wall BC of nozzle 70.

For full expansion from a lance pressure $P_o$ to a nozzle exit pressure $P_e$, the nozzle exit Mach number $M_e$ is:

$$\frac{P_o}{P_e} = \left(1 + \frac{\gamma - 1}{2} M_e^2\right)^{\frac{\gamma}{\gamma-1}} \tag{4}$$

where $\gamma = C_p/C_v$ for the cleaning fluid.

Based on the exit Mach number $M_e$ from equation (4), the exit diameter $d_e$ of the nozzle based on a known throat diameter $d_T$ can be determined by:

$$\left(\frac{d_e}{d_T}\right)^2 = \frac{A_e}{A_T} = \frac{1}{M_e}\left[\left(\frac{2}{\gamma+1}\right)\left(1 + \frac{\gamma-1}{2} M_e^2\right)\right]^{\frac{\gamma+1}{2(\gamma-1)}} \tag{5}$$

where $A_e$=exit area and $A_T$=throat area.

The expansion angle $\omega$ is the angle made between successive positions of polar vector $r\angle\theta_K$ along line BE, where r is the radial distance from point O' to point K. From the sonic throat ($\omega$=0 for M=1) to an arbitrary Mach number M, expansion angle $\omega$ is:

$$\omega = \frac{1}{2}\left[\sqrt{\frac{\gamma+1}{\gamma-1}}\tan^{-1}\sqrt{\frac{\gamma-1}{\gamma+1}(M^2-1)} - \tan^{-1}\sqrt{M^2-1}\right] \tag{6}$$

The slope of the wall TB is given by:

$$\psi = \theta_B = \frac{\omega_e}{2} \tag{7}$$

where $\omega_e$ is computed from equation (6) with $M=M_e$.

At any location K along the expansion wave BE, the corresponding angle would be $\omega_K = f(M_K)$ and the angular coordinate of K is given by:

$$\theta_K = \omega_E - \omega_K \tag{8}$$

By varying $M_B < M_K < M_E$, it is possible to trace the expansion along BE. In so doing, the curve defining curvilinear wall BC is obtained. This is done by solving the characteristic equations along the wave KL, leading to the coordinate of any point along BC, such as point L in FIG. 4B, is given by:

$$X_L = \frac{d_e}{4\mathrm{Sin}(\psi/2)}\left(\frac{\lambda_K}{\lambda_e}\right)\frac{1 + F(\theta_K)(\cos\theta_k\sqrt{M_k^2-1} - \mathrm{Sin}\theta_k)}{\mathrm{Sin}\theta_k\sqrt{M_k^2-1} + \cos\theta_k} \tag{9}$$

and $$Y_L = \frac{d_e}{4\mathrm{Sin}(\theta/2)}\left(\frac{\lambda_k}{\lambda_e}\right)F(\theta_k) \tag{10}$$

where $$F^2(\theta_k) = \sin^2\theta_k + 2(\cos\theta_k - \cos\psi)(\sqrt{M_k^2-1}\ \mathrm{Sin}\theta_k + \cos\theta_k) \tag{11}$$

and $$\lambda^2 = \frac{1}{M}\left[\frac{2}{\gamma+1} + \frac{\gamma-1}{\gamma+1}M^2\right]^{\frac{\gamma+1}{2(\gamma-1)}} \tag{12}$$

The underlying assumption thus far has been that the described flow is point source flow from origin O'. The dimension $X_L$ in equation (9) represents a length based upon this origin. However, the actual flow in the real nozzle is planar and uniformly distributed at the throat 77 in FIG. 4B. Hence, the axial distances have to be adjusted by subtracting the length O'F from valve $X_L$ calculated using equation (9). The length O'F is given by:

$$O'F = \frac{d_e}{2\lambda_e}\left[\mathrm{Cot}\psi - \frac{\lambda_B\cos(\psi/2) - 1}{2\mathrm{Cos}(\psi/2)[\mathrm{Sin}(\psi/2) + \mathrm{Cos}(\psi/2)]}\right] \tag{13}$$

Equations (4) through (13) provide the essence of the design procedure for this nozzle where sonic flow at the throat is expanded radially along wall TB and made parallel by wall BC.

Referring to FIG. 4C and the division of nozzle 49 into flow regions, the interior channel of nozzle 70 is defined by passageway ACDO and is symmetrical about axis 89. Inlet region I, denoted by numeral 93 and defined by ATFO, is similar to that found in conventional nozzles. In region II, denoted by numeral 94 and defined by TBEF, the cleaning agent expands through the conical section defined by wall TB. Within region II, wall TB is defined by divergence angle $\psi$ denoted by numeral 96. Prior to exiting region II, the cleaning agent substantially fully expands, though the cleaning agent emerging from region II is no longer traveling parallel to the nozzle axis 89.

In region III, denoted by numeral 97 and defined by BCE, the velocity vectors of the cleaning agent are redirected parallel with axis 89 such that the cleaning agent emerging from zone IV exiting nozzle 70 is a substantially fully expanded and flowing parallel to axis 89. In region IV, denoted by numeral 98 and defined by ECD, essentially no change occurs in the cleaning agent jet.

As shown in Table II above, the length $L_n$ of the expansion chamber 82 of contour nozzle 70 is too great to be mounted in a conventional lance tube. However, contour nozzle 70 can be truncated at approximately point E, denoted by numeral 91 in FIG. 4C, without noticing any appreciable decrease of performance in the nozzle 70. The location of point E with respect to the origin O' is given by:

$$O'E = \frac{d_e}{4\mathrm{Sin}\left(\frac{\psi}{2}\right)} \tag{14}$$

As with the distances calculated in equation (9), this distance must be reduced by the length O'F from equation (13) to account for the planar flow in the nozzle throat.

Truncating nozzle 70 past point E starts to reduce the nozzle's ability to produce a high valve for PIP. Minimum loss occurs in truncating nozzle 70 because the cleaning agent passing through expansion chamber 82 is fully expanded at point E and no thermodynamic change in the fluid occurs in region IV. What is gained is a full expansion nozzle capable of being mounted in a conventional lance tube and having the mass flow of conventional nozzles.

Figure 5:
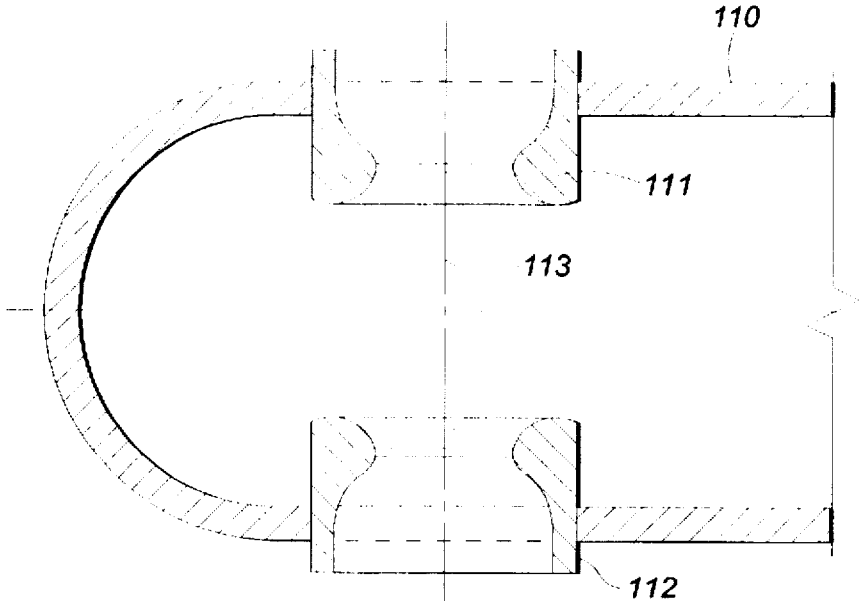
FIG. 5 is a vertical sectional view of a sootblower shown in FIG. 1.

An alternative mounting configuration to that shown in FIG. 1 is illustrated in FIG. 5. Lance tube 110 includes a pair of nozzles 111, 112 in diametrically opposite relation positioned coaxially along axis 113. The nozzles 111, 112 are constructed in accordance with rapid expansion nozzles disclosed as the first embodiment of the present invention through the contour nozzle disclosed as the second embodiment can also be mounted similarly.

Figure 6:
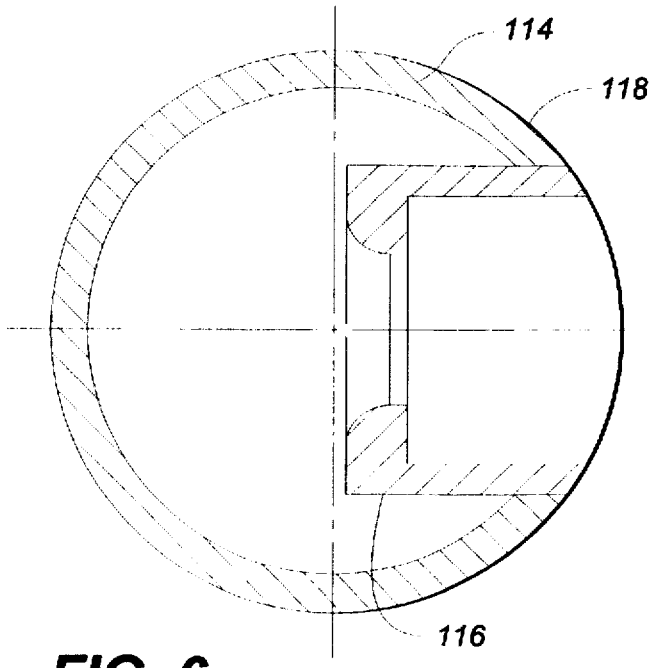
FIG. 6 is a cross-sectional view of a portion of a sootblower showing the profile of a nozzle constructed in accordance with the present invention mounted flush with the outer surface of the lance of the sootblower.

In reference to FIG. 6, nozzle 116, mounted to lance tube 114 and constructed in accordance with the present invention, may be mounted flush and contoured to the arcuate outer surface 118 of lance tube 114 so that the lance tube 114 may be inserted into a boiler, not shown, with greater clearance.

Figure 7:
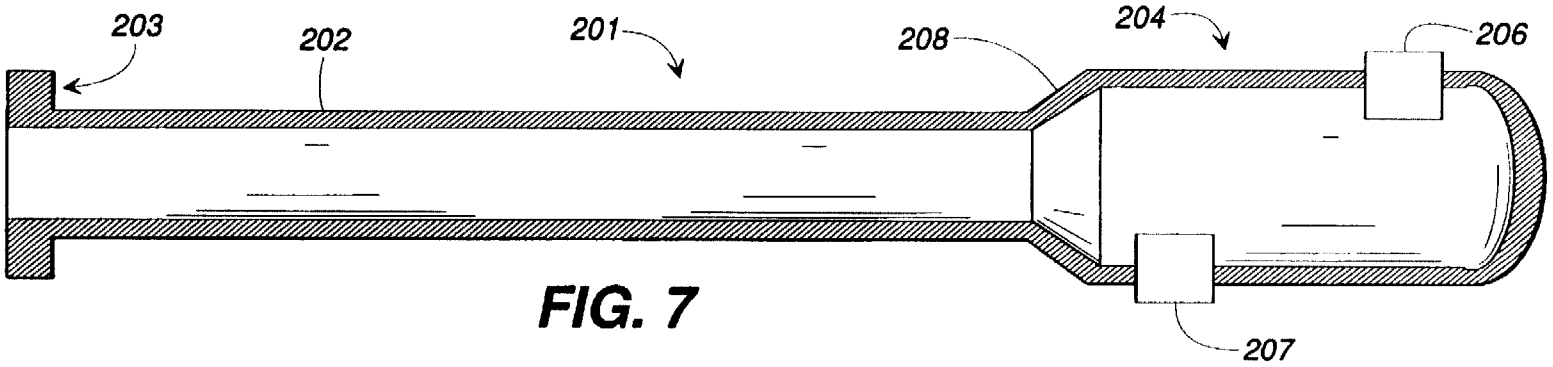
FIGS. 7 through 9 are cross-sectional views illustrating a sootblower lance with an expanded tip portion that embodies principles of the invention in one preferred form.
Figure 8:
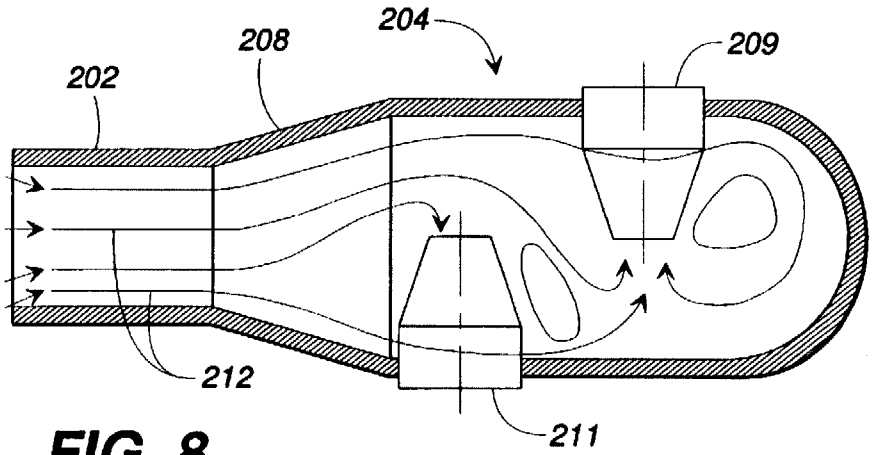
Figure 9:
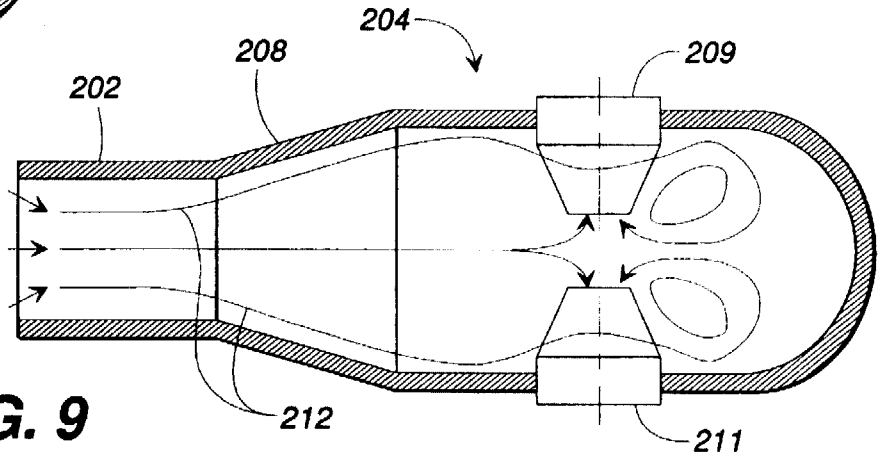

FIGS. 7 through 9 illustrate an improved sootblower lance with an expanded tip portion adapted to address the problem of restricted flow, turbulence, and reduced pressure that can occur in prior art lances. The lance 201 has a body 202 with a flange portion 203 at one end and a tip portion 204 at the other end. Mounted in the tip portion 204 are the sootblower nozzles 206 and 207, which extend partially into the interior of the tip portion as illustrated.

The tip portion 204 of the lance 201 is seen to be expanded relative to the body 202 of the lance. That is, the tip portion 204 has an interior diameter and an exterior diameter that are greater than the respective diameters of the body portions 202. With this configuration, it will be seen that the interior passageway within the tip 204 has a cross-sectional area that is greater than the cross-sectional area of the passageway within the body 202. Preferably, the expanded tip portion 204 is mounted to the body 202 by means of a collar or expander 208. In the embodiment of FIGS. 7 through 9, the expander 208 is shaped in the configuration of a frustrum so that the tip portion 204 expands through the expander at a gradual rate thus the expander 208 in the embodiment of FIGS. 7 through 9 can be said to be frustoconical in shape.

In FIG. 8, the tip portion 204 is shown coupled to the body 202 by the expander 208. A first nozzle 209 is mounted in the tip portion 204 and has a body that extends into the interior of the tip portion. Similarly, a second nozzle 211 is mounted in the tip portion on the opposite side of the nozzle 209 and also extends into the interior of the tip portion. In FIG. 8, the nozzles 209 and 211 are mounted in staggered opposed relationship as is sometimes desirable for certain applications. The nozzles 209 and 211 extend into the interior of the lance a distance almost equal to the diameter of the body portion 202. It will be obvious that if the nozzles were mounted in a lance within a non-expanded tip, their protrusions into the interior of the lance would provide a substantial obstruction to the flow of cleaning fluid within the lance. Thus, cleaning fluid passing one of the protruding nozzles does not encounter an obstruction or restriction any greater than that presented by the fully open passageway of the body portion itself. Thus, the cleaning fluid flows freely past the inwardly protruding nozzle with some of the fluid entering the nozzle and issuing therefrom as a supersonic jet. The remainder of the fluid travels on down the tip portion of the lance as indicated by flow lines 212 to nozzles that are further downstream such as nozzle 209. Since the tip portion 204 is expanded, the cleaning fluid reaches the downstream nozzle with substantially the same pressure that it had when encountering the upstream nozzle. Thus, the problem of reduced pressure at downstream nozzles common in prior art lances is eliminated. The result is a higher pressure, more uniform, and more efficient cleaning jet pattern issuing from the nozzles in the lance tip.

In FIG. 9, the nozzles 209 and 211 are seen to be mounted in directly opposing relationship relative to each other. This configuration is possible where the nozzle bodies are short enough so that they do not collide with each other within the lance tip portion. As with the embodiment of FIG. 8, the expanded tip portion 204 of the lance provides an unrestricted flow of cleaning fluid as represented by flow lines 212, so that the fluid issues from the nozzles 209 and 211 as a high speed jet.

While the nozzles 209 and 211 in FIGS. 8 and 9 are shown oriented along a radius of the lance 201, it will be understood by those of skill in the art that these nozzles could be angled with respect to the radius to issue jets of cleaning fluid in other than radial directions. Further, while the nozzles have been illustrated as being positioned 180° apart, they might well be oriented around the lance tip at various angles depending upon the intended results. Thus, the particular positioning and orientation of the nozzles in FIGS. 7 through 9 and, indeed, in any of the figures, should not be considered a limitation of the present invention.

Figure 10:
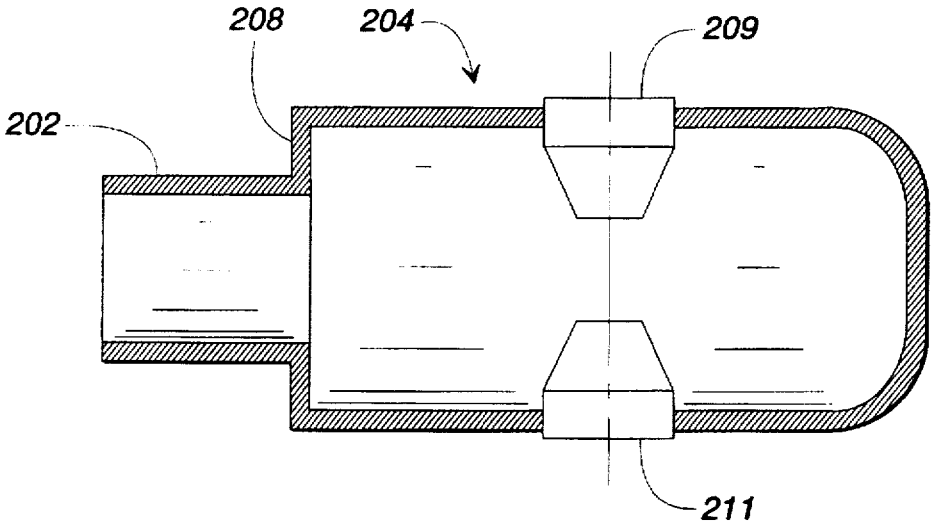
FIGS. 10 and 11 are cross-sectional views of a sootblower lance with expanded tip that embodies principles of the invention in an alternate form.
Figure 11:
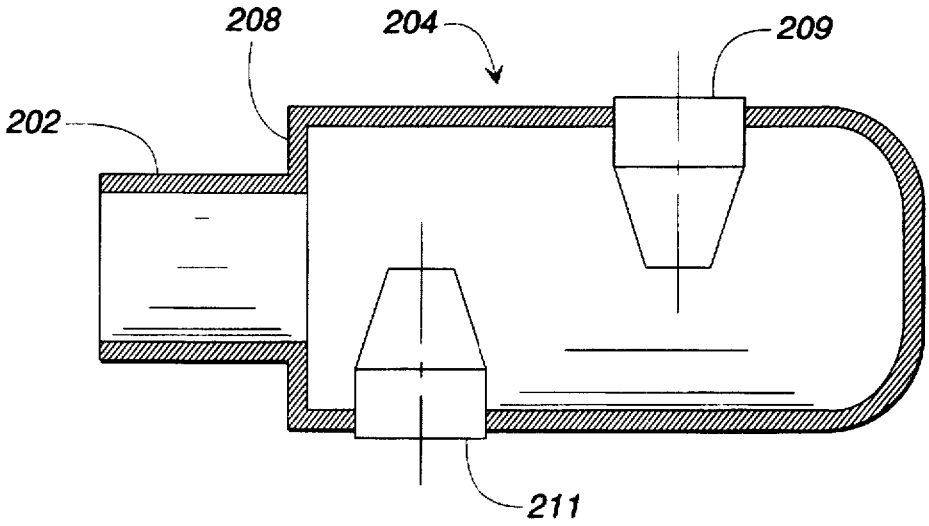

FIGS. 10 and 11 illustrate alternate embodiments of the expanded lance tip shown in FIGS. 7 through 9. In the embodiment of FIGS. 10 and 11, the expanded tip portion 204 and the mounting and orientation of the nozzles 209 and 211 are similar to that shown in FIGS. 7 through 9. However, in this embodiment, the expanded tip portion 204 is mounted to the body 202 by means of an annular disc shaped expander 208. This provides an abrupt expansion from the body 202 into the expanded tip portion 204. The same advantages apply to the embodiment of FIGS. 10 and 11 that apply to the previously discussed embodiment of FIGS. 7 through 9.

Figure 12:
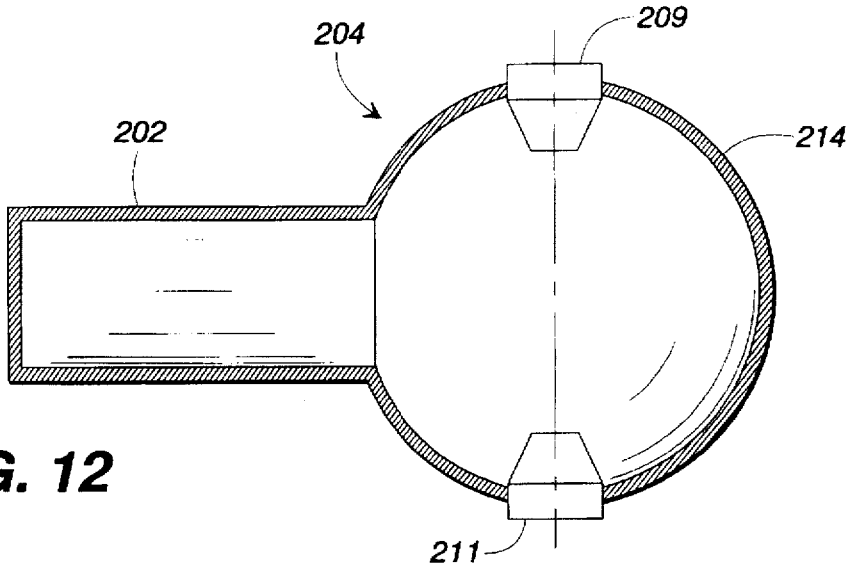
FIGS. 12 through 14 are cross-sectional views illustrating still another embodiment of a sootblower lance with a spherical expanded tip portion.
Figure 13:
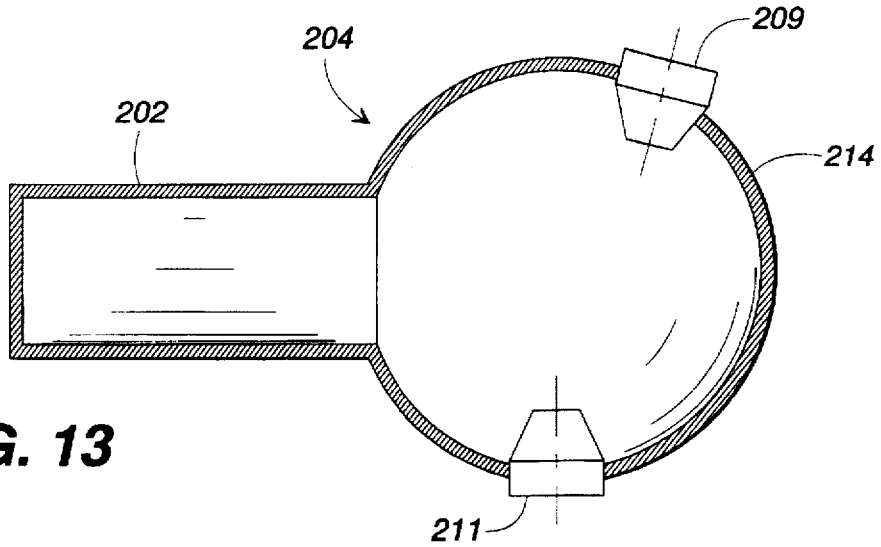

FIGS. 12 and 13 illustrate still another embodiment of the expanded tip portion 204. In this embodiment, the expanded tip portion 204 is configured in the shape of a sphere 214. The sphere 214 is connected directly to the body 202 of the lance without an intervening expander or collar. Nozzles 209 and 211 are mounted within the spherical expanded tip 204 and have bodies that extend into the interior portion of the sphere 214. In FIG. 12, the nozzles 209 and 211 are mounted in opposed aligned relationship. Conversely in FIG. 13, the nozzles 209 and 211 are mounted at random angles with respect to each other.

Figure 14:
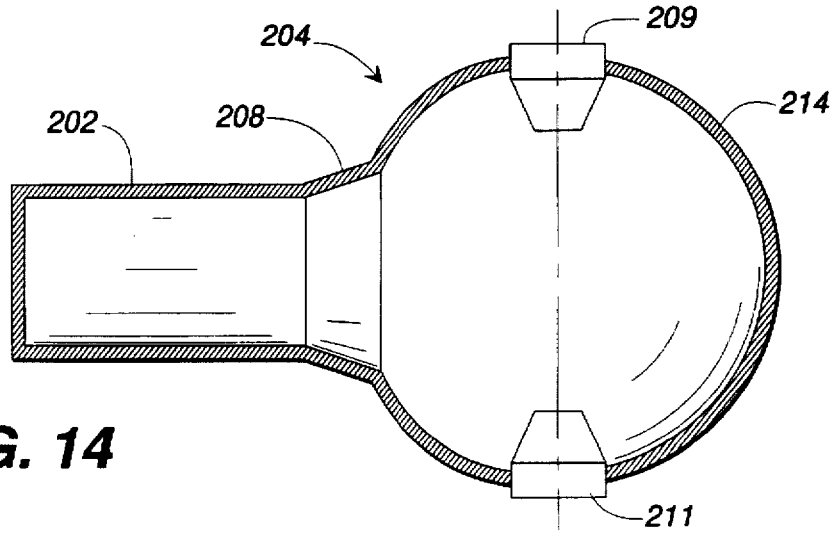

The spherical expanded tip portion 204 of FIGS. 12 and 13 provide unique advantages. In particular, the nozzles 209 and 211, and additional nozzles for that matter, can be mounted in the spherical tip portion 204 at virtually any position and at any angle. A nozzle could, for example, be mounted directly at the end of the tip portion to issue a jet of cleaning fluid in the forward direction. Further, nozzles could be positioned near the body 202 at the back of the sphere 214 to direct jets of cleaning fluid in a rearward direction. The nozzles can easily be oriented in any direction and at any angle around the sphere 214. Thus, a sootblower lance such as that shown in FIGS. 12 and 13 with a spherically expanded tip portion could be easily customized to clean hard to reach areas in particular boilers by issuing jets in precisely controlled directions. FIG. 14 shows a sootblower with a spherical tip portion connected to the lance body through a frustroconical expander ring as discussed above relative to FIGS. 7 through 9.

The invention has been described herein in terms of preferred embodiments and methodologies. It will be obvious to those skilled in this art, however, that various modifications might be made to the illustrated embodiments without departing from the spirit and scope of the invention as set forth in the claims.

I claim:

1. In a sootblower for cleaning fireside deposits from convective surfaces of a fuel-fired boiler wherein the sootblower includes an elongated hollow lance tube having a longitudinal axis through which a cleaning agent is supplied under pressure with Laval nozzles being mounted in the lance tube for generating supersonic jets of cleaning agent and directing the jets onto surfaces to be cleaned, said lance tube being selectively insertable into the boiler for supplying cleaning agent under pressure to the interior of the boiler, the improvement comprising an expanded tip portion on said lance tube with said expanded tip portion having an interior diameter greater than the interior diameter of the lance tube.

2. The improvement of claim 1 and wherein said nozzles are mounted in said expanded tip portion.

3. The improvement of claim 2 and wherein at least two of said Laval nozzles are mounted at longitudinally staggered positions along said expanded tip portion.

4. The improvement of claim 2 and wherein said Laval nozzles are mounted in circumferentially aligned relationship relative to each other in said expanded tip portion.

5. The improvement of claim 4 and wherein said Laval nozzles are mounted in opposed relationship relative to each other in said expanded tip portion.

6. The improvement of claim 1 and wherein said expanded tip portion is substantially cylindrical.

7. The improvement of claim 1 and wherein said expanded tip portion is substantially spherical.

8. The improvement of claim 7 and wherein at least two of said Laval nozzles are mounted in said spherical expanded tip portion in diametrically opposed relationship relative to each other.

9. The improvement of claim 7 and wherein at least two of said Laval nozzles are mounted in said spherical expanded tip portion in non-diametrically aligned relationship relative to each other.

10. The improvement of claim 1 and further comprising an expander collar securing said expanded tip portion to said lance tube.

11. The improvement of claim 10 and wherein said expander collar is frustoconical and has an interior diameter that progressively increases from said lance tube toward said expanded tip portion to provide a gradually expanding path for cleaning agent moving from said lance tube to said expanded tip portion.

12. The improvement of claim 10 and wherein said expander collar is annular disk-shaped.

13. A sootblower lance for insertion into a fuel-fired boiler to clean combustion deposits from internal surfaces of the boiler by directing supersonic jets of compressible cleaning agent onto the interior surfaces, said sootblower lance comprising an elongated lance tube having an end and a longitudinally extending internal passageway defining a first internal diameter, an expanded substantially hollow tip portion on said end of said lance tube in communication with said internal passageway, said tip portion having a second internal diameter greater than said first internal diameter, at least one Laval nozzle mounted in said expanded tip portion for generating a supersonic jet of cleaning agent and directing the jet in a predetermined direction relative to said expanded tip portion, and an expander collar disposed between and coupling together said end of said lance tube and said expanded tip portion.

14. A sootblower lance as claimed in claim 13 and wherein said expanded tip portion is substantially cylindrically shaped and has a closed distal end.

15. A sootblower lance as claimed in claim 14 and wherein at least a pair of Laval nozzles are mounted in said expanded tip portion of said lance tube.

16. A sootblower lance as claimed in claim 15 and wherein said Laval nozzles are mounted in circumferentially aligned relationship in said expanded tip portion of said lance tube.

17. A sootblower lance as claimed in claim 15 and wherein said Laval nozzles are mounted in circumferentially staggered relationship in said expanded tip portion of said lance tube.

18. A sootblower lance as claimed in claim 13 and wherein said expanded tip portion is substantially spherically shaped.

19. A sootblower lance as claimed in claim 18 and wherein said Laval nozzles are mounted in diametrically opposed relationship in said spherically shaped expanded tip portion.

20. A sootblower lance as claimed in claim 18 and wherein said Laval nozzles are mounted at random positions in said spherical expanded tip portion to direct jets of cleaning agent in predetermined random directions relative to said lance tube.

21. A sootblower lance as claimed in claim 13 and wherein said expander collar has an internal diameter that increases progressively from said end of said lance tube to said expanded tip portion of said sootblower lance.

22. A sootblower lance as claimed in claim 13 and wherein said expander collar comprises a substantially annular disc coupling said end of said lance tube to said expanded tip portion to provide an abrupt expansion from said lance tube to said expanded tip portion.

23. A sootblower lance for insertion into a fuel-fired boiler to clean combustion deposits from internal surfaces of the boiler by directing supersonic jets of compressible cleaning agent onto the interior surfaces, said sootblower lance comprising an elongated lance tube having an end and a longitudinally extending internal passageway defining a first internal diameter, a substantially hollow tip portion on said end of said lance tube in communication with said internal passageway, and at least one Laval nozzle mounted in said tip portion for generating a supersonic jet of cleaning agent and directing the jet in a predetermined direction relative to said tip portion, said Laval nozzle having an inlet end disposed inside said tip portion and a discharge end exposed to ambiance for directing cleaning agent from said lance, said tip portion having an interior dimension greater than said first internal diameter to define an interior wall that is sized and configured to be spaced from the inlet end of said Laval nozzle a predetermined distance sufficient to maintain cleaning agent pressure above a predetermined threshold as the cleaning agent transitions from the lance into the Laval nozzle.

24. A sootblower lance as claimed in claim 23 and further comprising at least a pair of Laval nozzles mounted at longitudinally spaced apart locations in said tip portion and wherein said interior wall of said tip portion is further sized and configured to be spaced from the inlet end of each of said pair of Laval nozzles a predetermined distance sufficient to maintain cleaning agent pressure above a predetermined threshold at the inlet ends of both of said Laval nozzles.

* * * * *